US006586387B2

(12) United States Patent
Srinivas et al.

(10) Patent No.: US 6,586,387 B2
(45) Date of Patent: Jul. 1, 2003

(54) LAUNDRY DETERGENT COMPOSITIONS CONTAINING A SOIL RELEASE POLYMER

(75) Inventors: Bala Srinivas, Hasbrouck Heights, NJ (US); Jenn S. Shih, Paramus, NJ (US)

(73) Assignee: ISP Investments Inc., Wilmington, DE (US)

( * ) Notice: Subject to any disclaimer, the term of this patent is extended or adjusted under 35 U.S.C. 154(b) by 47 days.

(21) Appl. No.: 09/827,890

(22) Filed: Apr. 6, 2001

(65) Prior Publication Data

US 2002/0177542 A1 Nov. 28, 2002

(51) Int. Cl.[7] ..... C11D 3/37
(52) U.S. Cl. ..... 510/475
(58) Field of Search ..... 510/475

(56) References Cited

U.S. PATENT DOCUMENTS 4,579,681 A * 4/1986 Ruppert et al. ..... 252/542
4,614,519 A * 9/1986 Ruppert et al. ..... 8/137

FOREIGN PATENT DOCUMENTS

DE 19847808 A1 * 4/1999

* cited by examiner

*Primary Examiner*—John Hardee
(74) *Attorney, Agent, or Firm*—Walter Katz; William J. Davis; Marilyn J. Maue

(57) ABSTRACT

A laundry detergent composition which includes a standard detergent formulation and an effective soil releasing amount of vinyl caprolactam homopolymer having a K-value of at least 40, preferably 40–50.

7 Claims, 1 Drawing Sheet

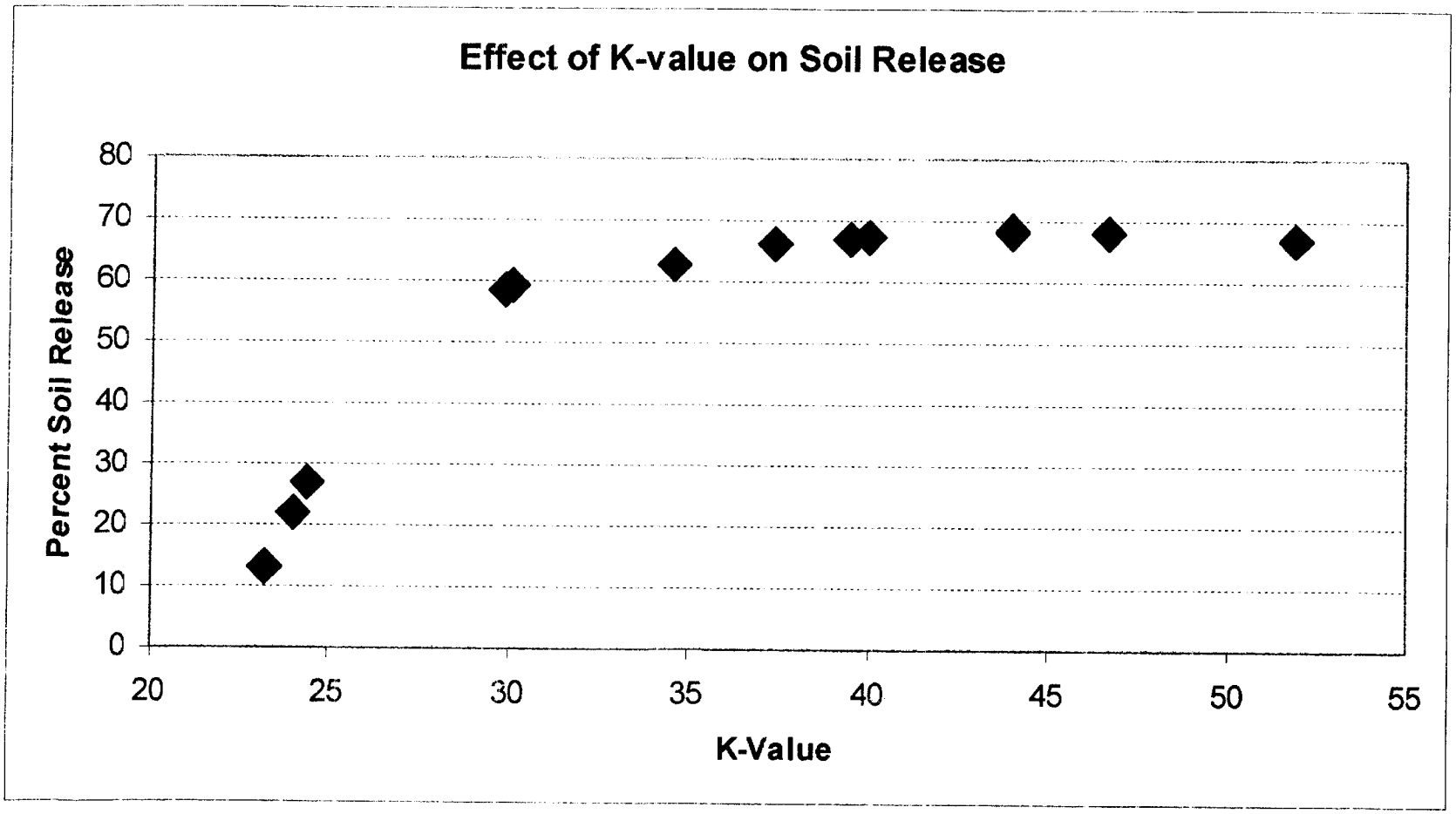
Effect of K-value on Soil Release
Percent Soil Release
80
70
60
50
40
30
20
10
0
20
25
30
35
40
45
50
55
K-Value

LAUNDRY DETERGENT COMPOSITIONS CONTAINING A SOIL RELEASE POLYMER

BACKGROUND OF THE INVENTION

1. Field of the Invention

This invention relates to laundry detergent compositions containing a soil release polymer, and, more particularly, to a standard detergent formulation containing a homopolymer of vinyl caprolactam having a K-value of at least 40, preferably 40–50, which have particularly effective soil release and fabric softening properties.

2. Description of the Prior Art

Non-ionic surfactants are useful in removing oily stains from fabrics. Moreover, the presence of a soil release polymer enhances the removal of these stains by providing a sacrificial barrier to the fabric, which is removed during wash. There are quite a few soil release polymers currently available for use in powdered detergents. However, most of these polymers work only on synthetic fibers and on blends but not on cotton. The ability of these polymers to function as effective soil release agents depends on the hydrophobic-hydrophilic balance of the polymer; in particular, it is the hydrophobic segment of the polymer which adsorbs onto the hydrophobic polyester surface leaving the hydrophilic component free to render the surface hydrophilic.

R. Ruppert et al, in U.S. Pat. Nos. 4,579,681 and 4,614,519, described laundry detergent compositions which included various vinyl caprolactam copolymers, and vinyl caprolactam homopolymer. The disclosed vinyl caprolactam copolymers (Exs. 1–4) and homopolymer (Ex. 5), were considered useful over a wide number average molecular weight range, extending from 1,000 to 1,000,000. In fact, the process for making the vinyl caprolactam homopolymer of Example 5 produced a homopolymer having a K-value of only 36. No other caprolactam homopolymers were prepared or tested by Ruppert.

Other laundry detergent compositions containing soil release polymers are described in U.S. Pat. Nos. 5,866,525; 5,789,365; 5,733,856; and 4,968,451; and WO95/07336.

Accordingly, it is an object of this invention to provide laundry detergent compositions including a vinyl caprolactam homopolymer of defined K-value which provides particularly effective soil releasing and fabric softening properties as compared to the homopolymer and copolymers of the prior art.

BRIEF DESCRIPTION OF THE DRAWING

The FIGURE is a plot of soil release effectiveness of laundry detergent compositions containing a vinyl caprolactam homopolymer vs. the K-values of the homopolymer.

SUMMARY OF THE INVENTION

What is described herein is a laundry detergent composition having advantageous soil releasing properties which contain a standard detergent formulation and including a vinyl caprolactam homopolymer having a K-value of at least 40, preferably 40–50.

DETAILED DESCRIPTION OF THE INVENTION

Test Procedure to Measure Soil Release Performance on Polyester:

Polymer: Variable Concentration ranging from 10 PPM

Typical Sample formulation Detergent: 5 g/L

Hard Water: 150 PPM with Ca:Mg: 3:1

Used/Dirty Motor Oil: 12 Drops symmetrically distributed per swath

Fabric: 2 Polyester Swaths per Terg-O-Tometer bin

Initially, a solution containing polymer, detergent and hard water are diluted to 1.0 L with deionized water and placed into a Terg-O-Tometer. Once the solution has equilibrated to 100° F., two polyester swaths are added and the washing process is conducted for 12 minutes at an agitation rate of 100 cycles/minute. The swatches are subsequently removed and rinsed in 150 PPM hard water for 3 minutes. Excess water is squeezed by hand and the swatches are allowed to dry. Once dry, 12 drops of dirty motor oil is symmetrically pipetted to each swath and allowed to stand overnight. A minimum of four reflectance measurements are taken per swath using a Hunter Colorimeter to obtain the average L,a,b and DE values for the swatches. Also the dE value is reported wherein a new, white polyester fabric is used as the reference.

A second wash is prepared containing detergent and hard water, which is again diluted to 1.0 L with deionized water and placed into a Terg-O-Tometer. Once the solution has equilibrated to 100° F., the two oil-stained polyester swaths are added and the washing process is conducted for 10 minutes at an agitation rate of 100 cycles/minute. The swatches are subsequently removed and rinsed in 150 PPM hard water for 3 minutes. Excess water is squeezed by hand and the swatches are allowed to dry. A minimum of four reflectance measurements are taken per swath using a Hunter Colorimeter to obtain the average L,a,b and DE values of the swatches.

Percent soil release is calculated as follows:

$$\%\ \text{Soil Release} = \frac{(DE)_{final} - (DE)_{oil}}{(DE)_{initial} - (DE)_{oil}}$$

$(DE)_{final}$: Reflectance measurement after second wash $(DE)_{oil}$: Reflectance measurement of oil-stained fabric $(DE)_{initial}$: Accepted value is 0.5

K-Value of Soil Release Polymer

The soil release K-values are measured as the relative viscosity of a 1% polymer solids solution in water. The viscometer tube used was a Cannon Fenske #75 tube. The bath temperature was 25° C. The relative viscosity of the sample solution against water was then converted to the K-value by use of the Fickentscher equation.

Referring now to the FIGURE, there is shown the critical relationship and effect of K-value of a homopolymer of vinyl caprolactam upon the soil release properties of a standard laundry detergent composition. At K-values of at least 40, preferably 40–50, of the vinyl caprolactam homopolymer, a maximum in the effectiveness of the composition is reached. Lower K-values of the homopolymer have substantially lower soil release properties.

The invention will now be described further with reference to the following examples.

PREPARATION OF VINYL CAPROLACTAM HOMOPOLYMER OF INVENTION (SUITABLE PROCESS CONDITIONS)

Polymerization

Temperature: 40° to 130° C.

Initiator: Free radical initiator

Amount of Initiator: 0.1% to 5%; preferably: 0.5% to 2%, by weight of monomer

% Solids: 10% to 80%; preferably: 30% to 60%

Solvent: Polyvinylcaprolactam-soluble, such as alcohol, and alcohol/water mixtures of defined ratios Monomer Feeding: optional Feeding Rate: up to 6 hours; preferably 1 to 3 hours Solvent Exchange:

Temperature: 40° C. to 100° C.; preferably: 50° C. to 80° C.

Final solids: 10% to 60%; preferably: 20–40%

Suspension agents: polyvinylpyrrolidone, hydroethylcellulose, polyvinylalcohol: 1% to 10%; preferably 3% to 6%

Product: 0–20% alcohol, rest water

EXAMPLE 1

P(VCL) Solution Polymerization and Methanol/Water Exchange

Into a 2-l, 4-neck resin kettle, fitted with a stainless steel anchor agitator, a nitrogen purge dip tube, an adapter and a reflux condenser, was added 100 g of N-vinylcaprolactam and 150 g of methanol. The mixture was heated to 60° C. with nitrogen purged throughout the run. After a tubal nitrogen purge for ½ hour, 0.3 g of t-butylperoxy pivalate (Lupersol® 11) initiator was added and the reaction was held at 60° C. for 3 hours. Then 6 booster shots of 0.1 g of Lupersol® 11 were added every 2 hours. Then 2 hours after the last shot, 5 g of poly(N-vinylpyrrolidone)/(K-30) in 150 g of D.I. water was added, the contents agitated and 150 g D.I. water added. The reactants were heated to 70° C. and methanol was removed under vacuum, and the solution was cooled to room temperature. The final solids content was 33%. The K-value of the homopolymer was 35.

EXAMPLE 2

P(VCL) Solution Polymerzation in Isopropanol

Into a 2-l, 4-neck resin kettle, fitted with a stainless steel anchor agitator, a nitrogen purge dip tube, an adapter and a reflux condenser, add 100 g of N-vinylcaprolactam and 150 g of isopropanol. The mixture was heated to 60° C. and purged nitrogen throughout the experiment. After purging nitrogen for ½ hour, add 0.3 g of initiator t-butylperoxy pivalate (Lupersol® 11) to kettle. The reaction is held at 60° C. for 3 hours. Then, 6 booster shots of 0.1 g of Lupersol-11 were added every 2 hours. Then 2 hours after the last booster, the solution was cooled. The final solids of the solution was 40%. The K-value was 30.

EXAMPLE 3

P(VCL) Solution Polymerzation in Isopropanol

Into a 2-l, 4-neck resin kettle, fitted with a stainless steel anchor agitator, a nitrogen purge dip tube, an adapter and a reflux condenser, add 100 g of N-vinylcaprolactam and 500 g of isopropanol. The mixture was heated to 60° C. and purged nitrogen throughout the experiment. After purging nitrogen for ½ hour, add 1.0 g of initiator t-butylperoxy pivalate (Lupersol® 11) to kettle. The reaction is held at 60° C. for 3 hours. Then, 6 booster shots of 0.1 g of Lupersol-11 were added every 2 hours. Then 2 hours after the last booster, the solution was cooled. The final solids of the solution was 40%. The K-value was 25.

EXAMPLE 4

P(VCL) Solution Polymerzation with Ethanol/Water Exchange

Into a 2-l, 4-neck resin kettle, fitted with a stainless steel anchor agitator, a nitrogen purge dip tube, an adapter and a reflux condenser, added 100 g of N-vinylcaprolactam and 150 g of ethanol. The mixture was heated to 60° C. and purged nitrogen throughout the experiment. After purging nitrogen for ½ hour, added 0.3 g of initiator t-butylperoxy pivalate (Lupersol® 11) to kettle. The reaction was held at 60° C. for 3 hours. Then, 6 booster shots of 0.1 g of Lupersol-11 were added every 2 hours. Waited for 2 hours after the last booster, then mixed 5 g of poly(N-vinylpyrrolidone) (K-30) in 150 g of D.I. water and transferred into the kettle. Mixed well and added 150 g D.I. water. Heated to 70° C. and pulled vacuum to remove the methanol. Cooled the solution. The final solids of the solution was 33%. The K-value was 42.

EXAMPLES 5–14

P(VCL) Monomer Pumped into Reactor

An N-vinylcaprolactam solution was prepared by mixing 139 g of water, 139 g of ethanol and 150 g of N-vinylcaprolactam. Into a 2-l, 4-neck resin kettle, fitted with a stainless steel anchor agitator, a nitrogen purge dip tube, an adapter and a reflux condenser, added 172 g of the mixture. The mixture then was heated to 60° C. and purged with nitrogen throughout the experiment. After purging nitrogen for ½ hour, added 0.06 g of initiator t-butylperoxy pivalate (Lupersol® 11) to kettle. The remainder of the 256 g of N-vinylcaprolactam ethanol/water solution was pumped into reactor over 2 hours. 0.073 g of initiator t-butylperoxy pivalate was charged 4 times every ½ hour during the feeding. After feeding, the reaction was held at 60° C. for 1 hour. Then 6 booster shots of 0.15 g of Lupersol® 11 were added every 2 hours. Waited for 2 hours after the last booster, and charged 220 g of D.I. water into the kettle. Heated to 60° C. and pull the vacuum to remove the Cooled the solution and adjust to 30% solids. The results are shown in the Table below and in the FIGURE.

TABLE

| Ex. No. | Water/Ethanol/VCL | % Solids | Water/Ethanol Wt. Ratio | K-Value of P(VCL) |
|---|---|---|---|---|
| 5 | 139/139/150 | 35 | 50/50 | 45.8 |
| 6 | 112.5/112.5/150 | 40 | 50/50 | 47.5 |
| 7 | 175/175/150 | 30 | 50/50 | 42.2 |
| 8 | 153.2/125.4/150 | 35 | 55/45 | 47.8 |
| 9 | 125.4/153.2/150 | 35 | 45/55 | 44.6 |
| 10 | 130/70/200 | 50 | 65/35 | 55.0 |
| 11 | 60/60/180 | 60 | 50/50 | 47.2 |
| 12 | 143/77/180 | 45 | 65/35 | 52.5 |
| 13 | 84/36/180 | 60 | 70/30 | 58.5 |
| 14 | 104/69/259.5 | 60 | 60/40 | 53.2 |

A steady maximum in the soil release properties is attained at the K-value of at least 40, and, preferably 40–50. The latter range provides a margin of error in the preparation of the VCL homopolymer. Lower K-values than 40 gives rise to a slippery slope in the soil release property where it drops off precipitously below about 40.

In a laundry detergent composition, the soil release polymer of the invention is used in a concentration of about 0.1 to 5% by weight, preferably 1 to 2%.

While the invention has been described with particular reference to certain embodiments thereof, it will be understood that changes and modifications may be made which are within the skill of the art. Accordingly, it is intended to be bound only by the following claims.

What is claimed is:

1. A laundry detergent composition which includes an effective soil-releasing and fabric softening amount of vinyl caprolactam homopolymer having a K-value of at least 40.

2. A laundry detergent composition according to claim 1 wherein said vinyl caprolactam homopolymer has a K-value of 40–50.

3. A laundry detergent composition according to claim 1 wherein said vinyl caprolactam homopolymer is present in an amount of 0.1 to 5% by weight of said composition.

4. A laundry detergent composition according to claim 1 wherein said homopolymer is admixed with polyvinylpyrrolidone.

5. A laundry detergent composition according to claim 1 wherein said homopolymer achieves 67–69% soil release throughout said K-value range.

6. A process for making a solution of vinyl caprolactam homopolymer which comprises solution polymerizing vinyl caprolactam monomer from an alcohol or water/alcohol mixture with sufficient initiator to produce a K-value of at least 40, and, if necessary, solvent exchanging with water to remove alcohol, or adding water thereto.

7. A process according to claim 6 wherein the K-value of the homopolymer is 40–50.

* * * * *